US005789038A

United States Patent [19]

Ono

[11] Patent Number: 5,789,038

[45] Date of Patent: Aug. 4, 1998

[54] SUPPORTING MECHANISM FOR A WOBBLE PLATE AND METHOD OF MAKING SAME

[75] Inventor: Tokihito Ono, Isesaki, Japan

[73] Assignee: Sanden Corporation, Gunma, Japan

[21] Appl. No.: 622,157

[22] Filed: Mar. 27, 1996

Related U.S. Application Data

[60] Continuation of Ser. No. 391,604, Feb. 21, 1995, abandoned, which is a division of Ser. No. 195,195, Feb. 14, 1994, Pat. No. 5,415,077.

[30] Foreign Application Priority Data

Feb. 15, 1993 [JP] Japan ..... 5-25232

[51] Int. Cl.[6] ..... B05D 1/18

[52] U.S. Cl. ..... 427/437; 427/438; 427/443.1; 205/80; 205/191

[58] Field of Search ..... 427/437, 438, 427/443.1; 205/80, 191

[56] References Cited

U.S. PATENT DOCUMENTS

| | | | |
|---|---|---|---|
| 3,716,348 | 2/1973 | Perkins | 29/195 |
| 4,122,215 | 10/1978 | Vratny | 427/92 |
| 4,484,988 | 11/1984 | Robinson | 204/35.1 |
| 4,621,026 | 11/1986 | Robinson | 428/422 |
| 4,716,059 | 12/1987 | Kim | 427/443.1 |
| 4,830,889 | 5/1989 | Henry et al. | 427/438 |
| 4,997,686 | 3/1991 | Feldstein et al. | 427/443.1 |
| 5,131,319 | 7/1992 | Ono et al. | 92/71 |
| 5,232,744 | 8/1993 | Nakamura et al. | 427/437 |

*Primary Examiner*—Benjamin Utech

*Attorney, Agent, or Firm*—Baker & Botts, L.L.P.

[57] ABSTRACT

A wobble plate in a wobble plate compressor has a bevel gear positioned at a central portion thereof. The bevel gear is provided with a centered ball seat. A second bevel gear is supported on the cylinder block and also has a centered ball seat. A bearing ball is seated in both of the ball seats so that the wobble plate nutates about the ball. At least one of the bevel gears is coated with electroless composite plating layer having a self-lubricative material, such as polytetrafluoroethylene (PTFE), dispersed therein. Consequently, the bevel gears have low frictional resistance, high hardness and improved anti-seizure characteristics.

8 Claims, 2 Drawing Sheets

SUPPORTING MECHANISM FOR A WOBBLE PLATE AND METHOD OF MAKING SAME

This application is a continuation of application Ser. No. 08/391,604, filed Feb. 21, 1995 (now abandoned), which is a divisional of Ser. No. 08/195,195, filed Feb. 14, 1994, (now U.S. Pat. No. 5,415,077 issued May 16, 1995).

BACKGROUND OF THE INVENTION

1. Field of the Invention

The present invention generally relates to a wobble plate type refrigerant compressor and, more particularly, to a thrust ball supporting mechanism for a wobble plate type compressor.

2. Description of the Prior Art

A thrust support mechanism of the wobble plate type refrigerant compressor is well known. For example, U.S. Pat. No. 4,870,893 to Takahashi discloses a refrigerant compressor wherein the rotation of the compressor drive shaft is converted into reciprocating motion through a cam rotor. The cam rotor has a sloping end surface and is mounted on an end of the drive shaft. A wobble plate bears against the cam rotor through needle bearings, and is supported on a fixed member such as a cylinder block in such a manner that the wobble plate nutates, but does not rotate. Thus, the rotation of the cam rotor causes wobble plate to nutate, and the piston rods connected to the wobble plate are reciprocated to compress fluid within the cylinders.

In a known wobble plate supporting mechanism, a bevel gear is fixed to the wobble plate at the center thereof and another bevel gear is fixedly supported on the cylinder block. The bevel gears mesh so that the bevel gear on the wobble plate is prevented from rotating. Both of the bevel gears have ball seats at their center in which a bearing ball sits. Thus, while the bevel gear on the wobble plate is prevented from rotating, it nutates along the ball surface.

The bearing ball and ball seats on the bevel gears are subjected to some of the largest axial loads in the compressor. Accordingly, proper lubrication of these parts is imperative. Under normal operating conditions, they are lubricated by a mist of lubricating oil generated by the moving parts the compressor. However, in the event that the compressor suffers a leakage of lubricating oil or continues to operate when the level of lubricating oil has decreased below a threshold level, the engaging surfaces may not be sufficiently lubricated, possibly resulting in abrading of the bearing ball or even failure of the compressor.

In addition, prior art bevel gear rotation prevention mechanisms are substantially rigid bodies. The metal to metal contact of the bevel gears has been known to cause considerable and undesirable noise and vibration. This in turn can reduce the marketability and effective life of the compressor.

It is these and other shortcomings of prior art wobble plate support mechanisms that the preferred embodiment seeks to address.

SUMMARY OF THE INVENTION

It is an object of the preferred embodiment to provide a wobble plate compressor having a more durable drive shaft supporting mechanism.

It is another object of the preferred embodiment to reduce the noise and vibration of the wobble plate compressor.

According to the preferred embodiment, the wobble plate type refrigerant compressor comprises a compressor housing having therein a cylinder block defined by a plurality of cylinders and a crank chamber adjacent the cylinders. A plurality of pistons are slidably fitted within each of the cylinders. A front end plate with a central opening is attached to one end surface of the compressor housing. A drive mechanism is coupled to the pistons to reciprocate the pistons within the cylinders.

The drive mechanism includes a drive shaft extending through the central opening of the front end plate and rotatably supported by a radial bearing in the central opening. A wedge-shaped cam rotor having an annular outer end surface is operatively connected to the drive shaft. A wobble plate is disposed in proximity with the annular outer end surface and has a first bevel gear attached to a central portion thereof. The first bevel gear has a ball seat on an end face thereof. A second bevel gear is supported on the cylinder block and also has a ball seat on an end face thereof. The first and second bevel gears are opposed to one another but also axially aligned. A bearing ball is seated between the first and second bevel gears in the respective ball seats. The bearing ball supports the wobble plate as it nutates about the center of the ball. Either one or both of the first or second bevel gears is coated with an electroless composite plating layer having self-lubricative material dispersed therein.

Further objects, features and other aspects of the present invention will be understood from the detailed description of the preferred embodiment with reference to the annexed drawings.

DETAILED DESCRIPTION OF THE PREFERRED EMBODIMENT

Figure 1:
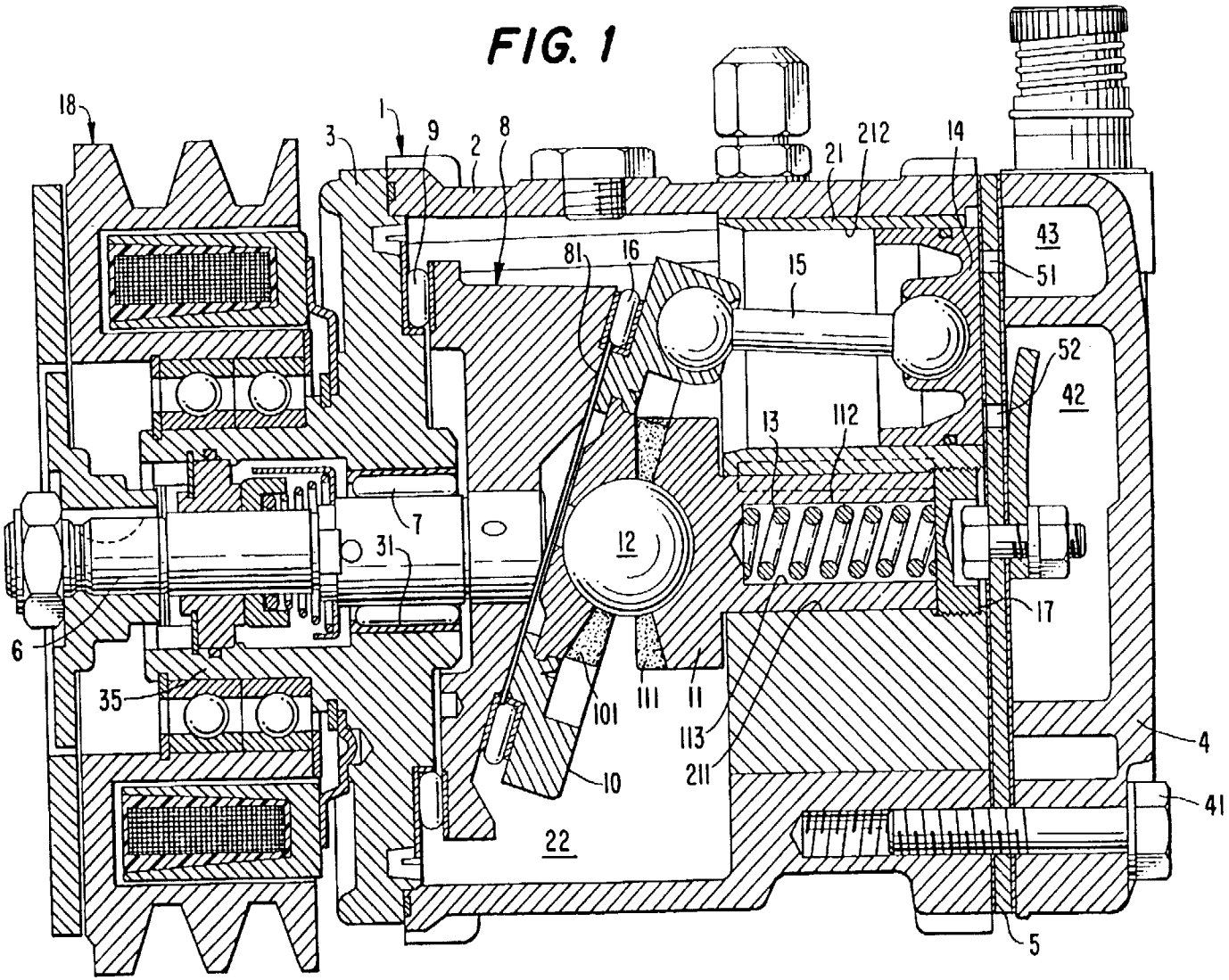
FIG. 1 is a longitudinal cross-sectional view of a wobble plate refrigerant compressor in accordance with the preferred embodiment.

With reference to FIG. 1, there is shown a wobble plate type compressor 1 having a conventional cantilever structure. Compressor 1 includes a cylindrical compressor housing 2 with a front end plate 3 and a rear end plate 4 at opposite ends thereof. Rear end plate 4 is in the form of a cylindrical head. Cylinder block 21 is located within compressor housing 2 and crank chamber 22 is formed between interior surface of compressor housing 2, cylinder block 21 and the interior surface of front end plate 3. Valve plate 5 covers the combined exterior surfaces of compressor housing 2 and cylinder block 21, and cylinder head 4 is attached to compressor housing 2 via bolts 41 extending through valve plate 5. Front end plate 3 includes opening 31 through a central portion thereof and through which drive shaft 6 extends into crank chamber 22.

Drive shaft 6 is rotatably supported within opening 31 of front end plate 3 by radial needle bearing 7. Wedge-shaped cam rotor 8 is fixedly coupled to the end of drive shaft 6 within crank chamber 22. Cam rotor 8 is also supported on the interior surface of front end plate 3 by thrust needle bearing 9. Drive shaft 6 and cam rotor 8 rotate in unison.

Wobble plate 10 is annular and is provided with first bevel gear 101 at its central portion. Wobble plate 10 engages inclined surface 81 of cam rotor 8 through thrust needle bearing 16. A supporting member 11 extends from cylinder block 21 to provide further support for wobble plate 10. Supporting member 11 includes shank portion 112 disposed within central bore 211 of cylindrical block 21, and second bevel gear 111 which engages first bevel gear 101 of wobble plate 10. Shank portion 112 includes hollow portion 113. Coil spring 13 is disposed within hollow portion 113 and urges supporting member 11 towards wobble plate 10. Adjusting screw 17 is disposed within central bore 211 adjacent the end of shank portion 112. A key (shown in phantom) is located between cylinder block 21 and supporting member 11 to prevent rotational motion of supporting member 11. Supporting member 11 nutatably supports wobble plate 10 with spherical element 12, (e.g., a steel ball) disposed between first bevel gear 101 and second bevel gear 111. The engagement of second bevel gear 111 with first bevel gear 101 prevents the rotation of wobble plate 10.

A plurality of cylinders 212 are uniformly spaced around the periphery of cylinder block 21. Pistons 14 are slidably fitted within each cylinder 212. Connecting rods 15 connect each piston 14 to the periphery of wobble plate 10 via a ball joint. Discharge chamber 42 is centrally formed within cylinder head 4. Suction chamber 43 has an annular shape and is located within cylinder head 4 at the periphery thereof, around discharge chamber 42. Suction holes 51 are formed through valve plate 5 to link suction chamber 43 with each cylinder 212 and discharge holes 52 are also formed through valve plate 5 to link each cylinder 212 with discharge chamber 42 as well.

A driving source rotates drive shaft 6 and cam rotor 8 via electromagnetic clutch 18 which is mounted on tubular extension 35 of front end plate 3. Wobble plate 10 nutates without rotating in accordance with the rotational movement of cam rotor 8, and each piston 14 reciprocates within cylinders 212. The recoil strength of spring 13 may be adjusted by rotating adjusting screw 17 to securely maintain the relative axial spacing between thrust bearing 9, cam rotor 8, wobble plate 10, first bevel gear 101, spherical element 12 and supporting member 11. However, the relative spacing may change when compressor 1 is operated due to dimensional error in the machining of the elements and due to changing temperature conditions within crank chamber 22.

In the preferred embodiment, first bevel gear 101 of wobble plate 10 and second bevel gear 111 of supporting member 11 are made of a steel, e.g., a case hardened steel or a cemented steel. In addition, at least one of the bevel gears 101, 111 has an inner and an outer plating layer. The inner plating layer is preferably an electrical plating layer while the outer plating layer comprises an electroless composite plating layer, such as a Ni or Co electroless composite plating layer, containing a self-lubricative material, such as polytetrafluoroethylene (hereafter referred to as PTFE), silicon carbide (SiC), molybdenum disulfide ($MoS_2$) or titanium nitride (TiN). Outer electroless plating layers are preferred over outer electric plating layers because outer electroless plating layers have substantially uniform and accurate thicknesses. Accordingly, this plating method, e.g., PTFE-dispersed Ni electroless composite plating, is suitable for plating uneven portions of component parts.

Figure 2:
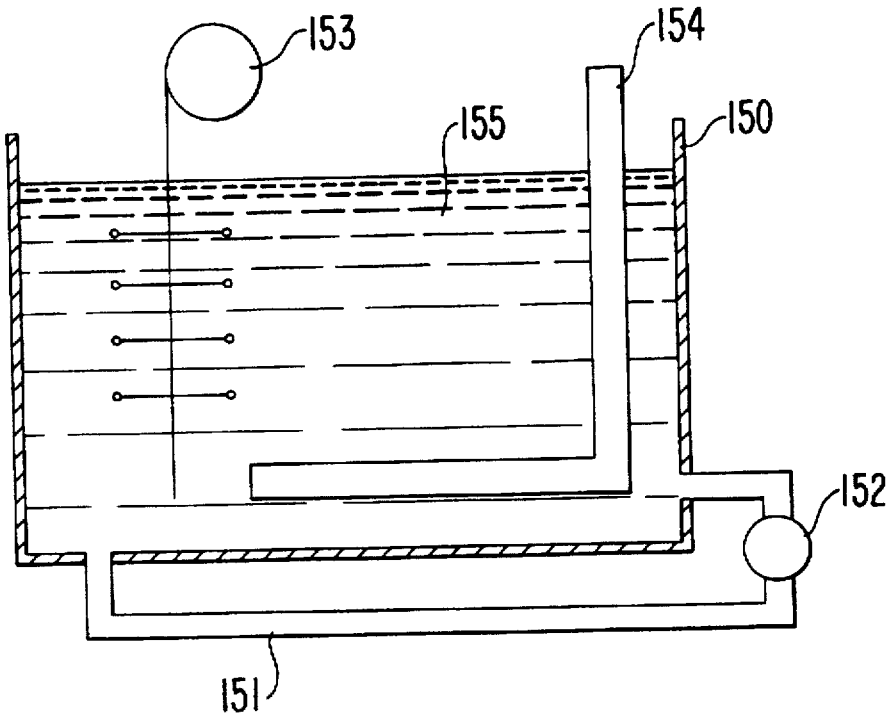
FIG. 2 is a schematic of the apparatus for plating the bevel gears of preferred embodiment.

With reference to FIG. 2, there is shown a schematic representation of the preferred plating apparatus. Plating bath 150 has a tube 151 extending between a bottom and a side wall thereof. A pump 152 positioned in tube 151 circulates the plating solvent within bath 150. Plating bath 150 has a jig 153 for fixing a part to be plated therein. Heater 154 is positioned within and heats plating bath 150. Plating bath is preferably filled with an electroless plating solvent 155.

The plating process is carried out as follows. First, the surfaces of bevel gears 101, 111 are treated with a decreasing solvent such as trichloroethane. Then, bevel gears 101, 111 are treated with an electrical reducing solution comprising a sal soda, sodium phosphate, a cyanide soda and a surface active agent. As defined, for example, in the McGraw-Hill Dictionary of Scientific and Technnical Terms (5th ed. 1994), the term "sal soda" means: "White, water-soluble crystals, insoluble in alcohol; melts and loses water at about 33° C; mild irritant to mucous membrane; used in cleansers and for washing textiles and bleaching linen and cotton. Also known as sodium carbonate decahydrate; washing soda." Id. at p. 1656. The term "cyanide" means: "Any of a group of compounds containing the CN group and derived from hydrogen cyanide, HCN." Id. at p. 473. The term "soda" refers to "sodium carbonate" and means: "A white, water-soluble powder that decomposes when heated to about 852° C.; used as a reagent; forms a monohydrate compound, $Na_2CO_3.H_2O$, and a decahydrate compound, $Na_2CO_3.10H_2O$. Also known as soda." Id. at pp. 1758, 1760. Therefore, the term "cyanide soda" refers to a mixture of soda and cyanide. The term "surface active agent" means: "A soluble compound that reduces the surface tension of liquids, or reduces interfacial tension between two liquids or a liquid and a solid. Also known as surfactant." Id. at p. 1862. Next, bevel gears 101, 111 are rinsed with water and treated with an aqueous solution comprising 10% by weight hydrochloric acid. Finally, bevel gears 101, 111 are plated first electrically and second electrolessly. In the first plating step, an inner plating layer is formed by applying a first ground coat comprising Ni to bevel gears 101, 111 by electrical application. In the second plating step, an outer plating layer is formed by applying a second ground coat comprising Ni to bevel gears 101, 111 by electroless application. Accordingly, bevel gears 101, 111 have an outer layer comprising an Ni electroless composite plating layer containing PTFE.

To achieve the second plating step, bevel gears 101, 111 (coated with the foregoing inner plating layer) are then (1) Immersed for about 2 hours in the following composite solvent bath maintained at about 85°–90° C.

| | Operating Range | Preferred |
|---|---|---|
| Ni: Nickel chloride | 3–7 g/l | 5 g/l |
| reducer: sodium hypophosphite | 25–35 g/l | 30 g/l |
| complexing agent: acenttic acid or malic acid | proper quantity | |
| lubricant: PTFE dispersion | proper quantity | |
| other: surface active agent | proper quantity | |

(2) Rinsed in a cold water bath;

(3) Dried; and (4) Heated at about 350° C. for about 45 minutes

Alternatively, the final heating step (4) may be omitted depending on whether the heating step is essential to properly coat the bevel gears.

After the plating process is complete, bevel gears 101, 111 have an outer plate between about 5–15 microns thick, and preferably 10 microns thick. The thickness of the plate layer is carefully controlled to be between the stated ranges. If the plate layer is not thick enough, the plated working surfaces of the bevel gears tend to varnish even under normal operating conditions. On the other hand, if the plate layer is too thick, the plated working surfaces of the bevel gears tend to peel under normal operating conditions.

The plate layer preferably comprises 67 to 77% by weight nickel (Ni), preferably 72% by weight Ni; 6 to 10% by weight phosphorus (P), preferably 8% by weight P; and 17 to 23% by weight PTFE, preferably 20% by weight PTFE.

An adhesion test based on JIS H8507 (Japanese Industry Standard H8507 corresponding to ISO 2819) was conducted in order to examine the seizure resistance of the PTE-dispersed Ni electroless composite plating on the bevel gears manufactured according to the preferred embodiment. Two tests in particular were selected from several adhesion tests specified in JIS H8507: (1) a grindability test and (2) a heat resistance test.

In the JIS H8507 grindability test, the bevel gears 101, 111 were secured to a grinding machine having a grinding stone of #60 grain size or grit and an H-M grade. As one of ordinary skill in the art will readily appreciate, the grade of a grinding wheel or stone is a measure of the strength of its bond (e.g., resin, rubber, shellac, glass, clay, sodium silicate). The complete range of grades spans the letters A–Z, with A the softest and Z the hardest. The force that acts on the grain in grinding depends on process variables (such as speeds, depth of cut, etc.) and the strength of the work material. Thus, a greater force on the grain will increase the possibility of dislodging the grain; if the bond is too strong, the grain will tend to get dull, and if it is too weak then wheel wear will be great.

The bevel gears 101, 111 were ground using a cutting speed between 10–33 m/s and an appropriate lubricating oil. If the plate layer is not sufficiently adhered to the metal of the bevel gears 101, 111, it should peel away under the influence of the grinding stone. This, however, did not occur in the plate layer according to the preferred embodiment.

Furthermore, in the JIS H8507 heat resistance test, the bevel gears 101, 111 were heated in a furnace to about 350° for about 45 minutes. No peel are expansion of the plate layer occurred after the bevel gears cooled to room temperature. The preferred embodiment, therefore, exceeds both JIS H8507 standards for grindability and heat resistance.

When at least one of the contacting surfaces of bevel gears 101, 111 are coated with the preferred Ni electroless composite plating layers having PTFE dispersed therein, the bevel gears 101, 111 exhibit low frictional resistance and high hardness. Thus, the preferred plating process improves anti-seizure and wear resistance properties of the compressor, which in turn enhances the performance of the compressor as well as reducing noise and prolonging the effective life thereof.

Although the present invention has been described in connection with the preferred embodiment, the invention is not limited thereto. For example, this invention is not restricted to a wobble plate type refrigerant compressor, and could readily be adapted to other types of compressors by one of ordinary skill in the art. It will be easily understood by those of ordinary skill in the art that variations and modifications can be easily made within the scope of this invention as defined by the appended claims.

I claim:

1. A method of forming a composite layer on a bevel gear rotation prevention mechanism used in a wobble plate type compressor, said met hod comprising the steps of:

forming an inner layer on the rotation prevention mechanism by electrodeposition; and forming an outer layer on the inner layer, wherein the step of forming the outer layer comprises the steps of:

immersing the rotation prevention mechanism having the inner layer in a solvent bath comprising nickel, phosphorous and polytetrafluoroethylene;

rinsing the rotation prevention mechanism with an aqueous solution; and drying the rotation prevention mechanism.

2. The method of claim 1 wherein the method of forming the outer layer further comprises the step of:

heating the rotation prevention mechanism at about 350° C. for about 45 minutes.

3. The method of claim 1 wherein the outer layer comprises about 67 to 77% by weight nickel, about 6 to 10% by weight phosphorous and about 17 to 23% by weight polytetrafluoroethylene.

4. The method of claim 3 wherein the outer layer has a thickness of about 5 to 15 microns.

5. The method of claim 1 further comprising the step of treating the rotation prevention mechanism with an reducing solution comprising a sal soda, sodium phosphate, a cyanide soda and a surface active agent.

6. The method of claim 1 further comprising the step of treating the rotation prevention mechanism with a trichloroethane solvent.

7. The method of claim 1 wherein the immersing step comprises an electroless immersion of the rotation prevention mechanism in the solvent bath.

8. A method of forming composite layer on a bevel gear rotation prevention mechanism used in a wobble plate type compressor, said method comprising the steps of:

forming a first layer on the rotation prevention mechanism by coating the rotation prevention mechanism with a first layer of nickel by electrodeposition;

forming a second layer on the first layer by coating the rotation prevention mechanism with a second layer of nickel by electroless application; and forming a third layer on the second layer, the step of forming the third layer comprising:

immersing the rotation prevention mechanism having the first and second nickel layers in a solvent bath comprising nickel, phosphorous and polytetrafluoroethylene;

rinsing the rotation prevention mechanism with an aqueous solution; and drying the rotation prevention mechanism.

* * * * *